US006906605B2

(12) United States Patent
Lang

(10) Patent No.: US 6,906,605 B2
(45) Date of Patent: Jun. 14, 2005

(54) ELECTROMAGNET SYSTEM FOR A SWITCH

(75) Inventor: Volker Lang, Bonn (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 10/399,344

(22) PCT Filed: Jul. 27, 2002

(86) PCT No.: PCT/EP02/08402

§ 371 (c)(1),
(2), (4) Date: Apr. 16, 2003

(87) PCT Pub. No.: WO03/017308

PCT Pub. Date: Feb. 27, 2003

(65) Prior Publication Data

US 2004/0027775 A1 Feb. 12, 2004

(30) Foreign Application Priority Data

Aug. 17, 2001 (DE) ..... 101 40 559

(51) Int. Cl.[7] ..... H01H 9/00

(52) U.S. Cl. ..... 335/179; 335/132; 335/234; 335/236

(58) Field of Search ..... 335/132, 177–182, 335/229–234, 236–237

(56) References Cited

U.S. PATENT DOCUMENTS 4,020,433 A 4/1977 Uchidoi ..... 335/230
4,546,339 A * 10/1985 Kubach ..... 335/230
5,737,172 A 4/1998 Ohtsuka ..... 361/154

FOREIGN PATENT DOCUMENTS

| | | |
|---|---|---|
| DE | 1164548 | 3/1964 |
| DE | 1277420 | 9/1968 |
| DE | 3520879 | 9/1986 |
| DE | 3910810 | 10/1990 |
| DE | 19526038 | 1/1996 |
| FR | 1119635 | 6/1956 |
| WO | 9831034 | 7/1998 |

* cited by examiner

*Primary Examiner*—Ramon M. Barrera
(74) *Attorney, Agent, or Firm*—Davidson, Davidson & Kappel, LLC

(57) ABSTRACT

An electromagnet system for a switch includes a main magnetic circuit including a magnet yoke and a magnet armature mechanically linked to a contact apparatus. At least one permanent magnet is disposed in the main magnetic circuit for generating a holding force for the magnet armature. A shunt circuit is provided parallel with the main magnetic circuit so that the permanent magnet is a magnetic energy source for the shunt circuit. The shunt circuit includes pole legs and a yoke arc of the magnet yoke. The magnet armature is capable of contacting the pole legs so as to close the shunt circuit. An excitation winding is provided for each of the pole legs for to generating a pull-in force for the magnet armature. The electromagnet system is magnetically dimensioned such that a minimum magnetomotive force of the excitation windings is sufficient for opening the electromagnet system.

11 Claims, 2 Drawing Sheets

ELECTROMAGNET SYSTEM FOR A SWITCH

The present invention relates generally to an electromagnet system for a switch, and in particular to an electromagnet system for a switch contactor, the electromagnet system including a main magnetic circuit formed by a magnet yoke and a magnet armature, and including a shunt circuit which is closable via the magnet armature and is parallel to the main magnetic circuit.

BACKGROUND

Electromagnetic switch contactors are usually dimensioned electrically and magnetically so that little electric power is to be applied in the holding state of the magnet armature (e.g., German Patent Application 195 26 038 A1). This is recommended because devices of this type are in the holding state most of their operating time. Power consumption in the holding state has the disadvantage that the device heats up. Power losses of a few watts are typically expected in the holding state. For vacuum switchgears, considerably higher power losses may occur. Considering the fact that contactors or switches are mostly combined in one switch box, active measures for dissipating heat must be taken.

The use of electronics has not yet resulted in satisfactory improvement. Thus, known electronic approaches for electromagnet systems include controlling the power requirement via pulse width modulation. This method results in the need for generating increasingly narrower pulses in the circuit as power consumption decreases. As the pulses become narrower, harmonic components appear, which cause problems in electromagnetic shielding and compatibility.

A magnet system having a circuit system for generating pulse trains to regulate power consumption is presented in German Patent Application 39 10 810 A1 or in German Patent Application 195 26 038 A1, for example.

SUMMARY OF THE INVENTION

An object of the present invention is therefore to provide an electromagnet system in which the power loss in holding operation is reduced.

The present invention provides an electromagnet system for a switch. The electromagnetic switch includes: a main magnetic circuit including a magnet yoke and a magnet armature, the magnet armature being acted upon by a restoring device and being mechanically linked to a contact apparatus of the switch; at least one permanent magnet disposed in the main magnetic circuit and configured to generate a holding force for the magnet armature; a shunt circuit including a plurality of pole legs and a yoke arc of the magnet yoke, the yoke arc facing away from pole faces of the magnet yoke and being interrupted by a remanence air gap, the magnet armature being capable of contacting the pole legs so as to close the shunt circuit, the shunt circuit being parallel with the main magnetic circuit so that the permanent magnet is a magnetic energy source for the shunt circuit; a circuit system configured to electrically trigger the electromagnet system and to be operated in a stand-by mode when the magnet armature contacts the pole legs; and at least one excitation winding respectively associated with at least one of the pole legs, an electromagnetic force of the at least one excitation winding being configured to generate a pull-in force for the magnet armature. The electromagnet system is magnetically dimensioned such that a minimum magnetomotive force of the at least one excitation winding delivered by an energy accumulator to force a magnetic power of the permanent magnet into the shunt circuit is sufficient for opening the electromagnet system.

The magnet system is based on the following structure:

- a main magnetic circuit formed by a preferably U-shaped magnet yoke and a magnet armature;
- a contact apparatus of the switch, mechanically linked to the magnet armature, and a preferably spring-loaded magnet armature acted upon by a restoring device;
- at least one permanent magnet situated in the main magnetic circuit for generating the holding force for the magnet armature; and
- at least one excitation winding located on at least one pole leg, i.e., on the magnet yoke, for generating the pull-in force for the magnet armature isolated from the magnet yoke. The electromagnet system is triggered electronically by an associated circuit system.

According to the present invention, parallel to the main magnetic circuit, a shunt circuit is provided, which is also closable via the magnet armature and the shunt circuit includes the two pole legs and a second yoke arc, which is situated on the magnet yoke facing away from the pole faces and is interrupted by a remanence air gap.

Additional advantageous embodiments include the following:

The magnet system (magnet yoke, second yoke arc, and permanent magnet) is magnetically dimensioned such that the holding power—when the magnet armature is pulled in—is applied by the permanent magnet alone without the excitation winding being energized.

The permanent magnet generates a first magnetic force flux (MK1) via the pole legs and the magnet armature, and a second force flux (MK2) via the shunt circuit and the remanence flux gap. The absolute value of the two force fluxes is therefore determined by the state of charge of the permanent magnet. The ratio of the force fluxes is determined by the dimensioning of the shunt circuit (including the remanence air gap) and the distance of the magnet armature. The first magnetic force flux (MK1) is responsible for securely holding the magnet armature on the pole faces. This armature holding force counteracts the spring force which opens the magnet system when there is little or no magnetic force. In this case, the magnet armature moves to stops, which are not shown. The excess armature holding force, generated via the magnetic flux by the magnet armature, over the spring force is a measure of the sensitivity of the magnet system to external mechanical interference. A minimum magnetomotive force (lowest current through the excitation coils, depending on the number of turns per unit length) should be sufficient for opening the magnet system, whereby the first magnet flux is weakened to the point that the spring force is sufficient to lift the magnet armature. The above-mentioned low excitation current generates a magnetic flux which is opposite the flux through the magnet armature and which essentially displaces the first magnetic force flow into the shunt circuit virtually without loss.

To close the magnet system, a considerably higher excitation current is used, which is sufficient to overcome the spring force at maximum magnet armature stroke. As the magnet armature approaches the pole faces, the magnetic fluxes shift between the main and shunt flux circuits, while the magnetic energy remains constant.

The magnet yoke has a U-shaped design and has two L-shaped halves, each having a longer pole leg and a shorter cross leg, one pole leg of each half facing the contact faces of the magnet armature. The permanent magnet is clamped in the center between the cross legs without welding. The second yoke arc is parallel to the cross legs.

The remanence air gap, whose width is on the order of magnitude of 0.3 mm, may be filled with air or with a non-magnetic material.

The excitation winding of the magnet system is connected to an energy accumulator, whose energy content is sufficient for releasing the magnet armature from the holding state. The energy accumulator may be an accumulator capacitor or an inductor.

A monitoring unit for controlling the voltage state of the energy accumulator is preferably associated with the circuit system, which makes it possible to switch the system to another power source or to output an error signal.

An advantage of the present invention is that it permits a circuit system (preferably having pulse width modulation) for activating the excitation winding and delivering electric power for the excitation winding to be operated virtually in the stand-by mode.

The EMC measures may be reduced because in the holding state only the electric power for the idling power of the circuit must be provided. In comparable magnet systems, the power is cyclical in the holding state, whereby interference fields cannot be avoided. The cutout power is minimal. The holding power is low and corresponds to the standby power of the control electronics. The design of the electronics is determined only by its own power consumption. From the point of view of power, the magnetic circuit is designed only for the "close magnet armature" situation. The cutout power should preferably be ensured in the pull-in phase, for example, by charging a capacitor during the pull-in phase. As is the case in comparable systems, the permanent magnet is made of a magnetically hard material, for example, of AlNiCo, rare earth compounds being also utilizable.

The advantage of the magnet system is in particular that less space is needed for the excitation coil, permitting a more compact design.

The present invention may be used in general wherever the motion of the magnet armature is convertible into the form of a linear drive.

BRIEF DESCRIPTION OF THE DRAWINGS

The present invention will be elaborated upon below based on exemplary embodiments with reference to the drawings, in which.

DETAILED DESCRIPTION

Figure 1:
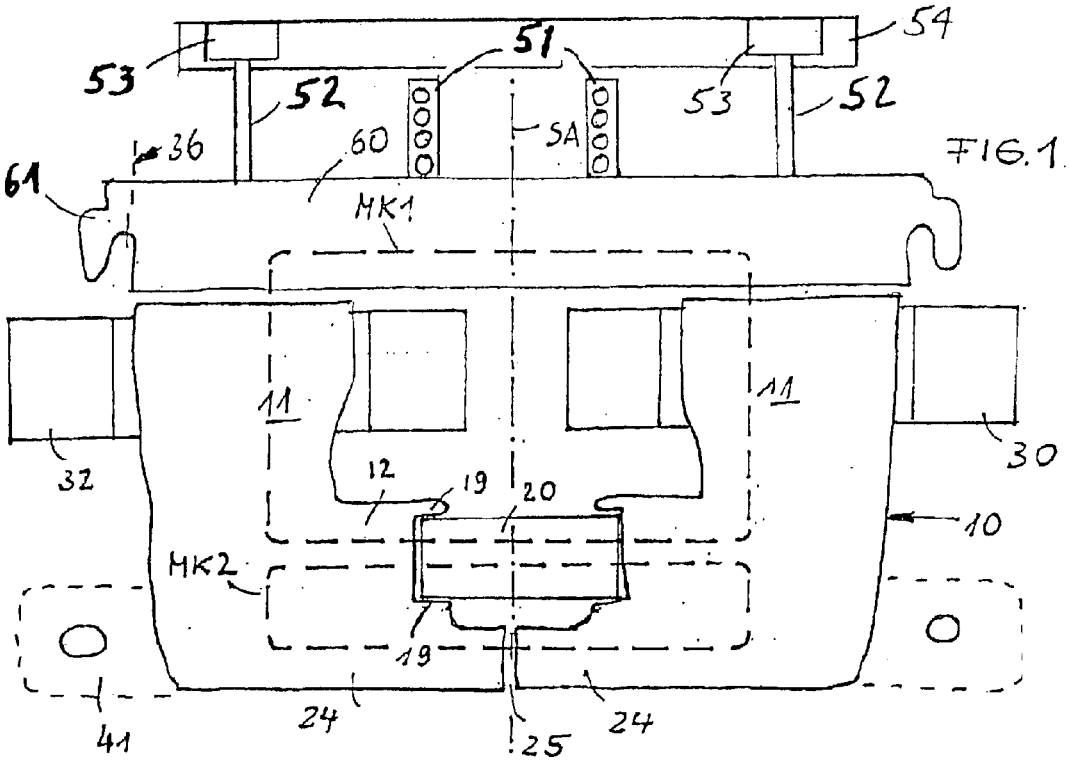
FIG. 1 shows a schematic diagram of an electromagnet system having a pulled-in magnet armature.
Figure 2:
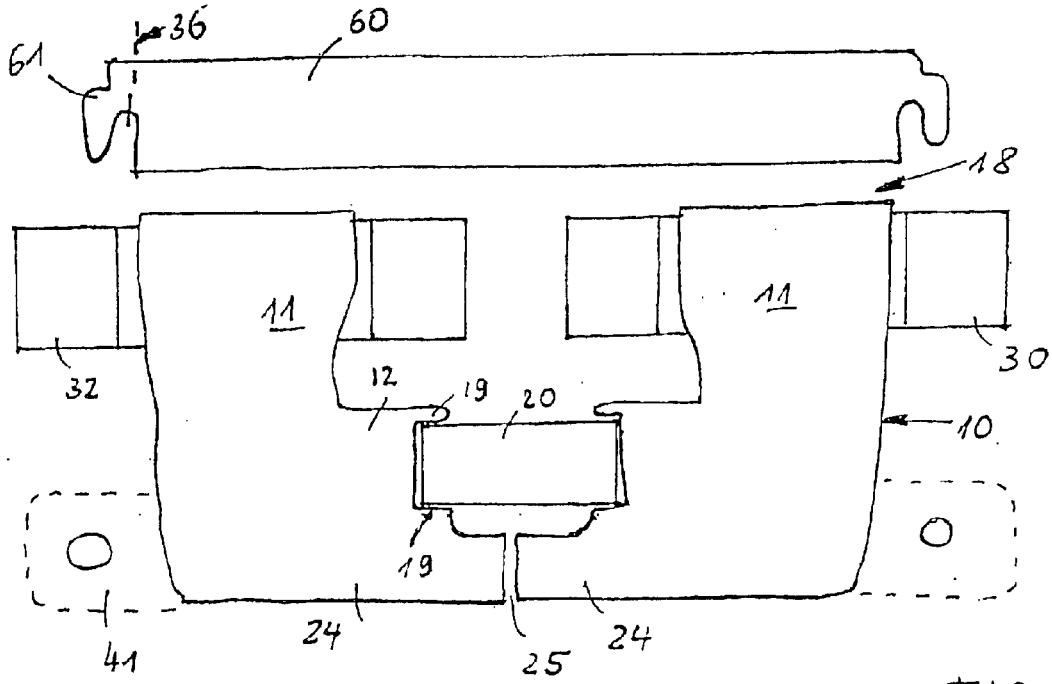
FIG. 2 shows a schematic diagram of an electromagnet system having a lifted magnet armature.
Figure 3:
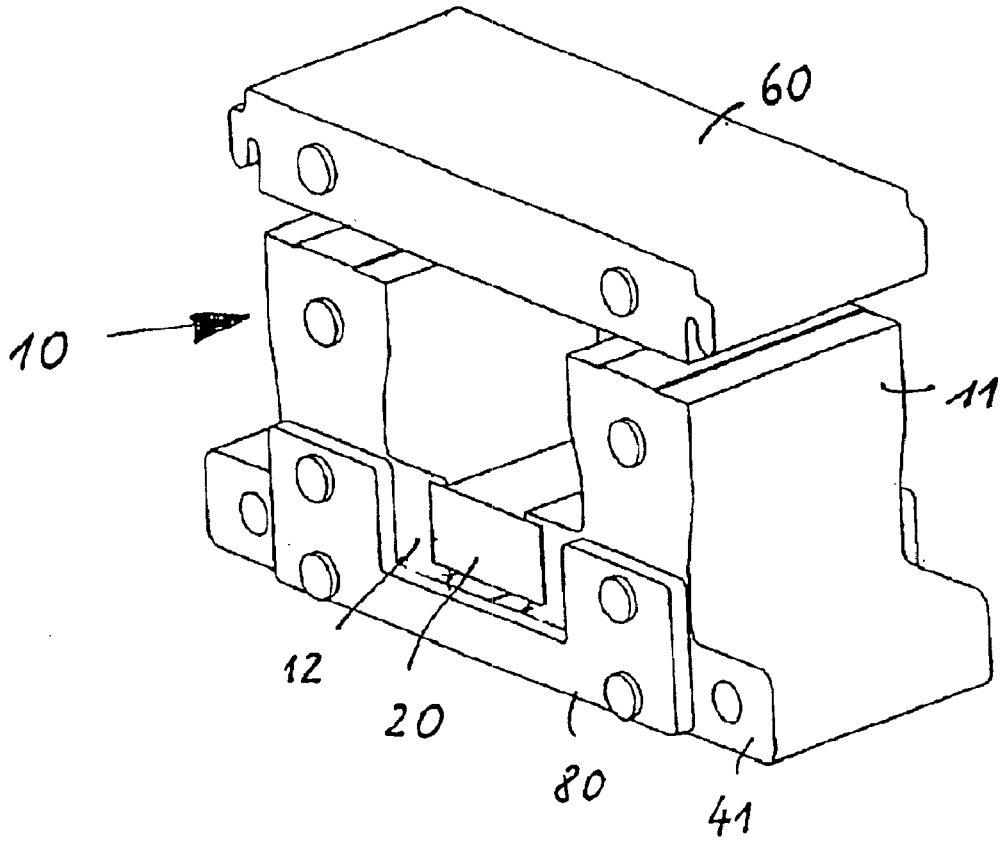
FIG. 3 shows a perspective view of an electromagnet system as an assembly drawing.

Magnet yoke 10 has a U shape and has two symmetric halves (in an L shape) with respect to the vertical axis of symmetry SA with longer pole legs 11 and short cross legs 12. The cross legs are facing each other. A permanent magnet 20 is mounted between the cross legs. For this purpose, the ends of the cross legs have projections 19, between which the permanent magnet is clamped during assembly. In contrast to comparable magnet constructions, where expensive laser welding joints are used, this is an elegant and simple construction. FIG. 3 shows the assembly drawing, where it can be seen that the magnet system is made of sheet metal stacks which are riveted through cover plates 80, resulting in mechanical cohesion.

The free ends of pole legs 11 form a plane as pole faces for magnet armature 60. Magnet armature 60 is made of a plate-shaped body having lateral extensions 61. A restoring force is applied to the magnet armature, which should be preferably linearly movable, by at least one spring 51. The magnet armature has an air gap or stroke 18. A mechanical link 52 exists between the magnet armature and a contact apparatus 53 of the switch or contactor 54.

The magnet yoke has its usual form as a sheet metal stack. Fastening legs 41, each having a bore hole, to which the magnet system may be attached in a housing, are situated laterally, facing cross legs 12.

A magnetic shunt circuit MK2, present on magnet yoke (11, 12) facing away from the pole faces, is associated with first magnetic flux circuit MK1. The shunt circuit is formed by two second yoke arc legs 24 (parallel legs) parallel to short cross legs 12. Cross legs and yoke arc legs are separated by a groove; otherwise they are material components of the magnet yoke.

Each pole leg 11 is surrounded by bobbins having excitation windings 30, 32. The magnetic flux generatable by excitation windings 30, 32 is superimposed in the air gap on the magnetic flux of permanent magnet 20. During the pull-in operation, the two magnetic fluxes are subtracted from each other in the shunt circuit.

Yoke arc legs 24 each have a smaller cross-section compared to first cross legs 12 and the magnet armature.

However, due to its function, during the pull-in operation, the highest magnetic flux density is in the magnet armature.

The yoke arc legs are separated by a remanence air gap 25. The width of the remanence air gap is approximately 0.3 mm. The ratio of magnetic flux MK1 to magnetic flux MK2 is defined by the cross sections of the yoke arc legs and the width of the remanence air gap.

Due to its magnetic energy, the permanent magnet generates a magnetic flux, which is split into the two magnetic flux circuits MK1 and MK2. The design of the magnet system, in particular the strength of the permanent magnet, is selected such that in the holding state (magnet armature pulled in, without being acted upon by the electric excitation via coils 30, 32) the magnet armature is held securely on the magnet yoke for all operating conditions.

Using this magnetic dimensioning, no magnetic power needs to be delivered by the excitation coils in the holding position; the holding force for the magnet armature is applied by the permanent magnet alone. This preferably makes it possible to minimize the electric power of the associated electronic circuit, because essentially only the triggering power is to be provided. The low triggering power may be adequately supplied, for example, by a suitably dimensioned accumulator capacitor or an inductor whose energy content may also be monitored by the electronic circuit.

It only requires a low power to move the magnet armature from the holding position to the open position (which may mean the OFF position of a switch, for example). This power is delivered by the control electronics to excitation windings 30, 32, whose magnetic flux weakens the flux through the pole faces to the point where the holding force is overcome.

The flux pattern changes accordingly, and the major portion of the magnetic power is forced into the shunt circuit (yoke arc leg 24, remanence air gap 25). An accumulator capacitor may be used for cutout, because a power of maximum 1 Watt is sufficient for this purpose. Such a capacitor has no significant power loss, so that only an idling power on the order of magnitude of considerably less than 1 Watt must be provided in the electrical trigger circuit system in the holding state.

The magnet system is driven (closing of the magnet armature, drive excitation) by a strong coil current (e.g., 100 Watt for 100 msec.) which generates a magnetic flux opposing that of the permanent magnet in the pole legs and also overcomes the spring force at the magnet armature. As the magnet armature approaches the pole faces, the density of the magnetic field in magnetic circuit MK1 increases. Magnetic shunt circuit MK2 now only contains a low magnetic energy.

After contact of the magnet armature with the pole faces (closing), the power flow may be turned off because (as explained above), the holding force is provided statically.

What is claimed is:

1. An electromagnet system for a switch, comprising:

a main magnetic circuit including a magnet yoke and a magnet armature, the magnet armature being acted upon by a restoring device and being mechanically linked to a contact apparatus of the switch;

at least one permanent magnet disposed in the main magnetic circuit and configured to generate a holding force for the magnet armature;

a shunt circuit including a plurality of pole legs and a yoke arc of the magnet yoke, the yoke arc facing away from pole faces of the magnet yoke and being interrupted by a remanence air gap, the magnet armature being capable of contacting the pole legs so as to close the main circuit, the shunt circuit being parallel with the main magnetic circuit so that the permanent magnet is a magnetic energy source for the shunt circuit;

a circuit system configured to electrically trigger the electromagnet system and to be operated in a stand-by mode when the magnet armature contacts the pole legs; and at least one excitation winding respectively associated with at least one of the pole legs, an electromagnetic force of the at least one excitation winding being configured to generate a pull-in force for the magnet armature;

wherein the electromagnet system is magnetically dimensioned such that a minimum magnetomotive force of the at least one excitation winding delivered by an energy accumulator to force a magnetic power of the permanent magnet into the shunt circuit is sufficient for opening the electromagnet system.

2. The electromagnet system as recited in claim 1 wherein the electromagnet system is for a switch contactor.

3. The electromagnet system as recited in claim 1 wherein the pole legs are connected via cover plates.

4. The electromagnet system as recited in claim 1 wherein the magnet yoke has a U-shape and includes a first and a second L-shaped halve, each L-shaped half including a respective pole leg and an associated respective cross leg, each respective pole leg being longer than the associated respective cross leg, each respective pole leg facing a respective contact face of the magnet armature.

5. The electromagnet system as recited in claim 4 wherein the permanent magnet is disposed in a central portion of the magnet yoke between the cross legs and is held by clamping.

6. The electromagnet system as recited in claim 4 wherein the yoke arc is disposed parallel to the cross legs.

7. The electromagnet system as recited in claim 4 wherein the permanent magnet is clamped between the cross legs.

8. The electromagnet system as recited in claim 1 further comprising a non-magnetic material disposed in the remanence air gap.

9. The electromagnet system as recited in claim 1 further comprising a magnetic sheet system.

10. The electromagnet system as recited in claim 1 wherein the energy accumulator is an accumulator capacitor.

11. The electromagnet system as recited in claim 1 wherein the energy accumulator is an inductor.

* * * * *